US008944262B2

(12) United States Patent
Willim et al.

(10) Patent No.: US 8,944,262 B2
(45) Date of Patent: Feb. 3, 2015

(54) LOAD HOOK CONTROL DEVICE FOR A CRANE

(75) Inventors: Hans-Dieter Willim, Ulm-Unterweiler (DE); Yggve Richter, Blaubeuren (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 160 days.

(21) Appl. No.: 13/040,453

(22) Filed: Mar. 4, 2011

(65) Prior Publication Data

US 2011/0272377 A1 Nov. 10, 2011

(30) Foreign Application Priority Data

Mar. 8, 2010 (DE) ..... 20 2010 003 269 U
Jun. 9, 2010 (DE) ..... 20 2010 012 237 U
Nov. 18, 2010 (DE) ..... 20 2010 015 616 U

(51) Int. Cl.
*B66C 13/06* (2006.01)
*B66C 23/18* (2006.01)

(52) U.S. Cl.
CPC ..... *B66C 13/06* (2013.01); *B66C 23/185* (2013.01)
USPC ..... 212/273

(58) Field of Classification Search
CPC ..... B66C 13/06; B66C 23/185; B66C 13/08; F03D 1/001; F05B 2230/61
USPC ..... 212/167, 285, 242, 259
IPC ..... B66C 1/34, 13/04, 13/40, 23/06, 23/10
See application file for complete search history.

(56) References Cited

U.S. PATENT DOCUMENTS

| | | | | |
|---|---|---|---|---|
| 6,474,922 | B2 * | 11/2002 | Bachman et al. | 414/21 |
| 6,644,486 | B2 * | 11/2003 | Jacoff et al. | 212/274 |
| 7,207,777 | B2 | 4/2007 | Bervang | |
| 2008/0017601 | A1 * | 1/2008 | Neupert et al. | 212/270 |
| 2008/0216301 | A1 * | 9/2008 | Hansen et al. | 29/428 |

FOREIGN PATENT DOCUMENTS

| | | |
|---|---|---|
| DE | 105793 | 5/1974 |
| DE | 69000566 | 6/1993 |
| DE | 29908395 | 9/1999 |
| DE | 60209494 | 8/2006 |
| DE | 202006015189 | 2/2008 |
| FR | 2926805 | 7/2009 |
| WO | 2008061797 | 5/2008 |

* cited by examiner

*Primary Examiner* — Emmanuel M Marcelo
*Assistant Examiner* — Angela Caligiuri
(74) *Attorney, Agent, or Firm* — Dilworth & Barrese, LLP.

(57) ABSTRACT

A crane, in particular a lattice mast crane, having a bottom hook block with a load suspension means, in particular a load hook, wherein the bottom hook block has at least one winch whose outgoing control rope is connected or connectable to the crane boom for securing and/or aligning the load position or bottom hook block position.

23 Claims, 9 Drawing Sheets

LOAD HOOK CONTROL DEVICE FOR A CRANE

BACKGROUND OF THE INVENTION

The present invention relates to a crane, in particular to a lattice mast crane; having a bottom hook block with a load suspension means, in particular a load hook.

When raising large loads at great heights, the robustness of the hoisting system toward external influences, in particular attacking wind forces, plays a decisive role. The large loads to be raised have a large surface and consequently offer a large exposed surface to the wind forces. The engaging forces result in a swaying of the load or an oscillating of the hook, which can have the consequence of an unstable hoist system. For safety reasons, limits are defined for maximum permitted wind speeds up to which a planned hoist may be carried out at all.

The robustness of the system with respect to the attacking wind forces is also a decisive criterion in the installation of the suspended load at a great height since an alignment of the load at the installation height which is as precise and as stable as possible is desirable here.

Since each individual hoist or each installation causes substantial equipment and operating costs, one objective in the development of such hoisting systems is the expansion of the maximum permitted limits for the wind speeds. If the limits can be made more flexible and more tolerant, a planned hoist can be carried out faster and less expensively.

A possible solution approach which allows a reliable alignment of the large loads susceptible to the wind in the installation of wind turbines, in particular of the suspended rotors or rotor blades, is known from the prior art. DE 20 2006 015 189 U1 proposes for this purpose the use of a frame for taking up a rotor blade, said frame being connected to the telescopic crane via a stabilizing guy rope connection. However, the apparatus disclosed therein relates specifically to the hoisting or the installation of rotor blades.

SUMMARY OF THE INVENTION

It is the object of the present invention to prevent or minimize the swaying of the load or the oscillating of the hook during the hoisting work and additionally to provide a possibility for the precise alignment of the load or of the hook respectively.

The aforesaid object is satisfied by the feature combination herein. Accordingly, in a crane, in particular a lattice mast crane, having a bottom hook block with load suspension means, in particular having a load hook, at least one winch is arranged on the bottom hook block. The outgoing control rope of at least one winch is connected or can be connected to the crane boom for the securing and/or precise orientation of the load or of the bottom hook block position. The control rope is spanned with the aid of the winch to prevent or minimize the swaying of the bottom hook block or the oscillation and rotation of the load suspended thereon. Furthermore, the bottom hook block with the suspended load can also be precisely aligned or positioned in great installation heights by corresponding winch actuation.

For the better taking up of the forces which are caused by the load and its alignment about a vertical axis, the roller head is configured as preferably widened at the tip of the crane boom. Consequently, the pulley blocks are configured as correspondingly wide at the bottom hook block. There is a large resistance per se to a rotation of the load and of the bottom hook block with respect to the roller head due to the large spacing of the two outer pulley blocks on the bottom hook block. The hoist rope of the crane is preferably reeved several times into the pulley blocks of the bottom hook block. The crane in accordance with the invention is advantageously also configurable as a crane having a multirope operation.

In a particularly preferred embodiment of the invention, a respective winch is arranged beside the outwardly disposed side of the two outermost pulley blocks of the bottom hook block. The resulting spacing of the winches and of the outgoing control ropes with respect to one another becomes a maximum, whereby a large torque for the positioning or aligning of the bottom hook block and of the suspended load can be generated with small rope force. The attachment of the winches can take place on a widened section of the bottom hook block attached laterally to the bottom hook block. The named widened section is preferably releasably connected to the bottom hook block. When the winches or the control ropes are not being used, they can be dismantled from the bottom hook block together with the winches for space or weight reasons.

A drive, in particular a hydraulic drive, is expediently arranged on the carrier of the bottom hook block for supplying at least one winch. The arrangement of the drive centrally on the carrier of the bottom hook block is conceivable, in particular centrally between two or more winches. The drive preferably has a motor, a fuel tank, a hydraulic tank and a control device for the motor and for the hydraulic lines.

It is furthermore conceivable that a communication unit is provided for the remote control of the drive. This is preferably arranged in the drive and communicates with the control device or devices of the drive. The drive can thus be comfortably controlled from the ground or from the control panel of the crane via a corresponding remote control. The drive can advantageously be partially or fully removed from the bottom hook block and this can then be used without a drive. A required rereeving of the hoist rope can possibly hereby be avoided.

In order always to ensure a good angle of the control rope for aligning the bottom hook block with suspended load with respect to the boom, in particular with changeable hoisting heights of the bottom hook block, it is of advantage if at least one control rope is displaceably connected to the crane boom parallel to the longitudinal boom axis.

In a particularly preferred embodiment of the invention, at least one guide rope is spanned parallel to the longitudinal boom axis. The outgoing control rope of at least one winch is connectable or connected longitudinally displaceably at an end side to the guide rope. It is conceivable that one or more guide ropes extend over large parts of the boom parallel to its longitudinal axis. For example, at least one winch which spans one or more guide ropes can be provided at the lower region of the boom, in particular at the boom foot. The guide rope or ropes itself or themselves are in turn fixed at one or more fixed points at the boom in the upper region of the boom. A supply and control unit is provided in winch proximity for the winch control and/or energy supply. Alternatively, the winch for spanning the guide rope or ropes can also be arranged in the boom head or in the fly boom.

For the displaceable fastening of at least one control rope at the boom or at the guide rope, the latter advantageously has a block at its free end which is provided with a roller. At least one control rope is displaceably supported along the guide rope parallel to the longitudinal boom axis by means of the roller.

A single guide rope without guying function is particularly preferably spanned from the boom foot almost parallel to the longitudinal boom axis and is fastened to the boom system at the end side. Almost parallel here means at least in the direction of the longitudinal boom axis.

It is also possible that the control rope or ropes is/are guided along a guide rope region of the crane hoist rope.

In an alternative embodiment variant of the crane in accordance with the invention, the control rope or ropes are directly fastened to the boom. It can be a guide rail having a slide connection attached to the boom. The control rope can naturally also be fixed non-displaceably indirectly or directly to the crane boom. However, in this case, an ideal angle of the control rope to the boom cannot be ensured at all times.

To increase the precision of the load alignment possibility, it is expedient to configure the hook of the bottom hook block as movable or rotatable. A rotary movement of the load hook about is longitudinal axis is conceivable. For this purpose, a hook drive is provided whose energy supply is preferably provided from the drive of the winches. For example, the load hook is rotatably supported by means of a rotating assembly with respect to the bottom hook block. The hook drive is accordingly configured as a rotary drive which is in communication with the rotating assembly and carries out the rotational movement.

It is possible that both the drive of the winches and the hook drive can be removed from the bottom hook block. This provides inter alia an additional space saving as well as a weight saving, which enables a less expensive hoisting process under certain circumstances.

The present invention furthermore relates to a bottom hook block for a crane, in particular for a lattice mast crane, in accordance with one of the aforesaid features. As already presented above, the bottom hook block in accordance with the invention accordingly has at least one winch whose outgoing control rope can be connected to a crane boom. The drive for supplying the at least one winch is expediently seated on the bottom hook block.

A second aspect of the invention relates to a crane having a frame which is suitable for taking up a specific load and which is suspended at the load hook of the crane. The frame is preferably suitable for taking up a rotor blade for a wind turbine. The crane is, however, not restricted to the taking up of a rotor blade. Any desired load can rather be taken up with the aid of the frame. For reasons of simplicity, the embodiment in accordance with the second aspect of the invention will nevertheless be explained in the following with reference to a frame for taking up a rotor blade.

In comparison with the prior art, only a single guide rope without guying function is provided which, starting from the boom foot, is spanned almost parallel to the longitudinal axis direction of the boom system and is fastened at the end side to the boom system. The load in the boom is halved with respect to the prior art since now only one single guide rope is spanned. The function of a guying which may be present is also not influenced.

The boom system of the crane in accordance with the second aspect of the invention can e.g. comprise a telescopic boom, a fly boom and, optionally, a main boom extension.

The frame suspended at the load hook for taking up a specific load is connected via at least two control ropes to the guide rope and is hereby sufficiently stabilized.

Preferred embodiment possibilities of the crane in accordance with a further aspect of the invention will be explained in more detail in the following part of the description.

The spanned guide rope can be fastened at the end side in a variable height to the boom system, depending on the use, independently of the boom system used. A fastening in sufficient proximity to the roller head of the boom system is preferred so that a guidance of the at least two control ropes used is ensured over the total hoisting height. It is sufficient with smaller hoisting heights to span the guide rope at the end side up to the corresponding region to the boom system.

The control ropes are guided at least partially along the guide rope. The guidance expediently takes place with the aid of guide rollers or the like.

The tension introduced onto the guide rope advantageously takes place by means of a winch which is preferably arranged in the region of the boom foot. An energy supply and a control connection with which the winch is coupled to the total crane bus system or to the crane control system is expediently located in the region of the boom foot in advance.

The winch is advantageously controlled in a synchronized manner by the crane control in dependence on a corresponding crane movement. A luffing movement of the fly boom or a telescoping of the corresponding boom part causes a letting out or a winding up of the guide rope controlled by the crane control with the aid of the winch. It is furthermore possible to provide the winch with a maximum coiling up force. On an exceeding of the limit value, the winch automatically lets out rope.

Alternatively, the winch can also be arranged indirectly or directly at the pivotal connection piece and/or at the superstructure and/or at a luffing ram.

It has proven expedient in this connection if the winch is arranged almost on the line of symmetry of the boom system. The spanned guide rope consequently extends on the line of symmetry formed in the direction of the boom tip up to the fastening point at the boom system. The lateral loads of the boom caused by the control ropes are substantially smaller in contrast with the prior art due to the arrangement of the winch on the line of symmetry. The single boom load results only from the introduced pressure load of the guide rope onto the boom system. The guide rope advantageously extends on the plane of symmetry on the boom side facing the load hook.

The control ropes advantageously extend, starting from the frame, to the guide rope and are redirected by one or more pulley blocks in the region of the connection point to the guide rope.

The connection of the control ropes to the guide rope advantageously takes place via a connection link. The connection link includes a double roller which either accepts the control ropes directly or is in indirect communication with the control ropes via pulley blocks. The connection link is guided on the guide rope via the double roller.

The arrangement of one or more pulley blocks on the frame, with the individual control ropes being redirected by them, is of advantage. In this case, the force in the rope and in the rope drive onto the frame can be reduced.

Finally, one or more winches can be arranged on the frame to vary the tension of the control ropes and so to keep the position of the frame stable.

In contrast to the prior art, the load can now be aligned with a very good angle, also when a long fly boom is used, due to the use of the guide rope in accordance with the second aspect of the invention. It must be noted in this connection that the main boom tension used in DE 20 2006 015 189 U1 for guiding the control ropes only runs along the main boom and not behind the fly boom. The hoisting height at which the stabilizing of the load taken up is made possible with the aid of the control ropes is accordingly limited to the region of the main boom guying.

It is likewise conceivable to retrofit already existing cranes accordingly with the aid of the shown technical teaching in accordance with the second aspect of the invention. In this case, an existing crane of any design can be retrofitted by the attachment of a winch in the region of the boom foot and of the guying of the guide ropes parallel to the longitudinal axis of the boom system.

The invention further relates to a crane in accordance with a third aspect, wherein the crane includes a load hook indirectly/directly fastened to the crane hoist rope, with a frame for taking up a specific load being fastened to said load hook. The frame is in particular suitable for taking up a rotor blade of a wind turbine.

Such frames are also called "yokes" in the technical jargon. This is a frame which receives the actual load in a gentle and damage-free manner. The connection between the load hook and the frame is expediently established via suspension means. To align and stabilize the yoke, it has independently working assemblies such as winches, drives, operating means, etc.

The frame used has at least two control elements in indirect communication with the crane boom for adjusting, stabilizing and finely aligning the frame or the load taken up. In accordance with the third aspect of the invention, it is now provided that the at least two control elements are guided along a guide rope region of the crane hoist rope. A region of the hoist rope used is accordingly created which provides a guidance possibility for the connected control elements. The attachment of a separate guide rope is consequently superfluous. Separate winches having a corresponding hydraulic and electric control to span the separate guide rope or ropes are likewise superfluous. The proposed solution considerably simplifies the crane production and is furthermore substantially less expensive than known designs.

The technical design of the crane in accordance with the third aspect of the invention is independent of the type of main boom used. It can, for example, be either a lattice mast boom or a telescopic boom.

A partial region of the hoist rope is preferably used as a guide rope region which extends almost parallel to the longitudinal boom axis at the boom side facing the load. It can be expedient for this purpose that the hoist rope is guided from the crane hook back to the boom and is spanned almost parallel to the longitudinal boom axis in the direction of the boom foot. The region of the hoist rope guided back is advantageously used as a guide rope region.

In a particularly advantageous embodiment of the crane, the guide rope region of the hoist rope is formed by the hoist rope which is guided back from the hook block in the direction of the boom, said hoist rope extending starting from the hook block via at least one pulley block at the boom in the direction of the longitudinal boom axis to the lower crane attachment point. At least one pulley block is furthermore expediently arranged at the roller head of the boom tip. One or more pulley blocks can preferably be provided at any desired point of the boom. For example at the main boom, at the boom extension or at the needle. For example the hub height of a wind turbine to be installed can be decisive.

At least one deflection pulley is advantageously installable or installed at variable height at the crane boom in the guide rope region of the hoist rope. The installation of the pulley block can take place, for example, in coordination with the target hoist height of the load to be achieved. The pulley is preferably bolted to the crane or is fastened to the crane by means of clamping means.

One or more control elements are particularly preferably configured as control ropes. Accordingly, at least two control ropes of the suspended frame are guided along the guide rope region of the hoist rope. The use of a control chain and/or of a spindle and/or of a cylinder and/or of a telescopic rod and/or of an articulated link is generally conceivable. The use of an element based on a scissors mechanism is furthermore also conceivable. The design is expediently identical for at least some of the control elements; however, any desired combination of the proposed embodiments is also possible.

The end-side attachment point of the hoist rope guided back is preferably at the pivot connection piece of the crane boom. The hoist rope can selectively be attached at the end side to the luffing ram or also to the revolving deck.

Provision can advantageously be made that a rope clamp is arranged at the hoist rope end. The hoist rope end can be attachable or attached to any desired point of the crane via the rope clamp depending on the specification profile.

The handling of the hoist rope end preferably takes place with the aid of an installation rope which is arranged at the end side at the hoist rope or rope clamp and which is either accessible from the standing position of the crane or alternatively via a drive. It is conceivable to operate the installation rope, in particular to wind it up or unwind it, by means of at least one winch. An already present installation rope of the reeving winch can be used as the installation rope, for example.

An advantageous embodiment of the crane in accordance with the third aspect of the invention includes at least one pulley block arranged in the guide rope region of the hoist rope and an apparatus for catching or fixing at least one guided control element. The control elements slide, in particular by means of a fastened connection link, along the guide rope region of the hoist rope in dependence on the hoisting height. The apparatus serves for fixing and stabilizing the control elements, in particular of the connection link, so that a precise control or fine adjustment of the frame can be ensured with the aid of the control elements.

The pulley block is in particular arranged at the crane such that the control elements or the connection link can be caught or fixed at the target hoist height of the taken up load to be reached. A pulley block designed variably installable at the boom preferably has the apparatus for catching and fixing. The installation of the pulley block takes place, for example, in the hub height region of a wind turbine to be installed. The attachment of the named pulley block at the boom just below the hoisting height to be achieved so that a premature catching and fixing of the control elements results in a specific and advantageous oblique pull of the control elements is particularly advantageous. The oblique pull boosts the achieved fixing of the control elements.

The apparatus of the pulley block advantageously comprises at least one plate which is pivotably supported about the pulley block axis and which has at least one attachment surface. The pivotable support of the plate ensures a targeted alignment of the attachment surface in dependence on the rope redirected by the pulley block.

The attachment surface is in particular arranged at the lower side of the plate and the rope is guided through the attachment surface orthogonally thereto. The rope particularly preferably runs orthogonally through the surface center of the attachment surface. The vertical movement of the control elements, sliding on the rope can consequently be limited to a maximum height by the attachment surface.

The plate of the apparatus preferably includes at least one holding roller which ensures a soft and damped positioning of the plate at the rope. This is in particular advantageous if the plate is deflected in any desired direction, which consequently results in an increase in the rope looping angle of the redirected rope at the pulley block. The pulling force arising in the rope acts as a restoring force and is taken up in damped form by the plate due to the holding roller.

A connection link is advantageously provided which is suitable for connecting at least one control element to the guide rope region of the hoist rope. The connection link preferably has at least one abutment surface which can be brought into abutment with the suitable counter-abutment surface of the pulley block described above. A fixing/stabilizing of the connection link at the pulley block is achieved by the targeted abutment between the connection link and the pulley block.

At least one slide block is preferably provided in the region of the abutment surface of the connection link. A targeted abutment of the two abutment surfaces is ensured with the aid of the slide block. The slide block furthermore effects an improved shape matching between the pulley block and the connection link in the caught position of the connection link.

The connection link is preferably configured rotatably about the rope axis of the hoist rope so that the movability of the control elements is not restricted or is only slightly restricted. In the caught state of the connection link, the slide block preferably slides about the surface periphery of the abutment surface of the pulley block.

A fourth aspect of the invention furthermore relates to a pulley block having an apparatus for catching and fixing at least one control element or one connection link respectively. The pulley block obviously has the same features and properties as the above embodiment of the crane in accordance with the third aspect of the invention so that a repeated discussion will be dispensed with at this point.

In a fifth aspect of the invention, a connection link is furthermore proposed which can be caught at or fixed to a pulley block by a corresponding apparatus. The connection link obviously has the same features and properties as the above embodiment of the crane in accordance with the third aspect of the invention so that a repeated discussion will be dispensed with at this point.

It is worthy of mention in this connection that the pulley block and the connection link can naturally also be used at a separate guide rope, not to be associated with the hoist rope, of any desired crane.

BRIEF DESCRIPTION OF THE DRAWINGS

Further features, details and advantages of the invention will be explained in more detail with reference to an embodiment shown in the drawings. There are shown.

DESCRIPTION OF THE PREFERRED EMBODIMENTS

Figure 1:
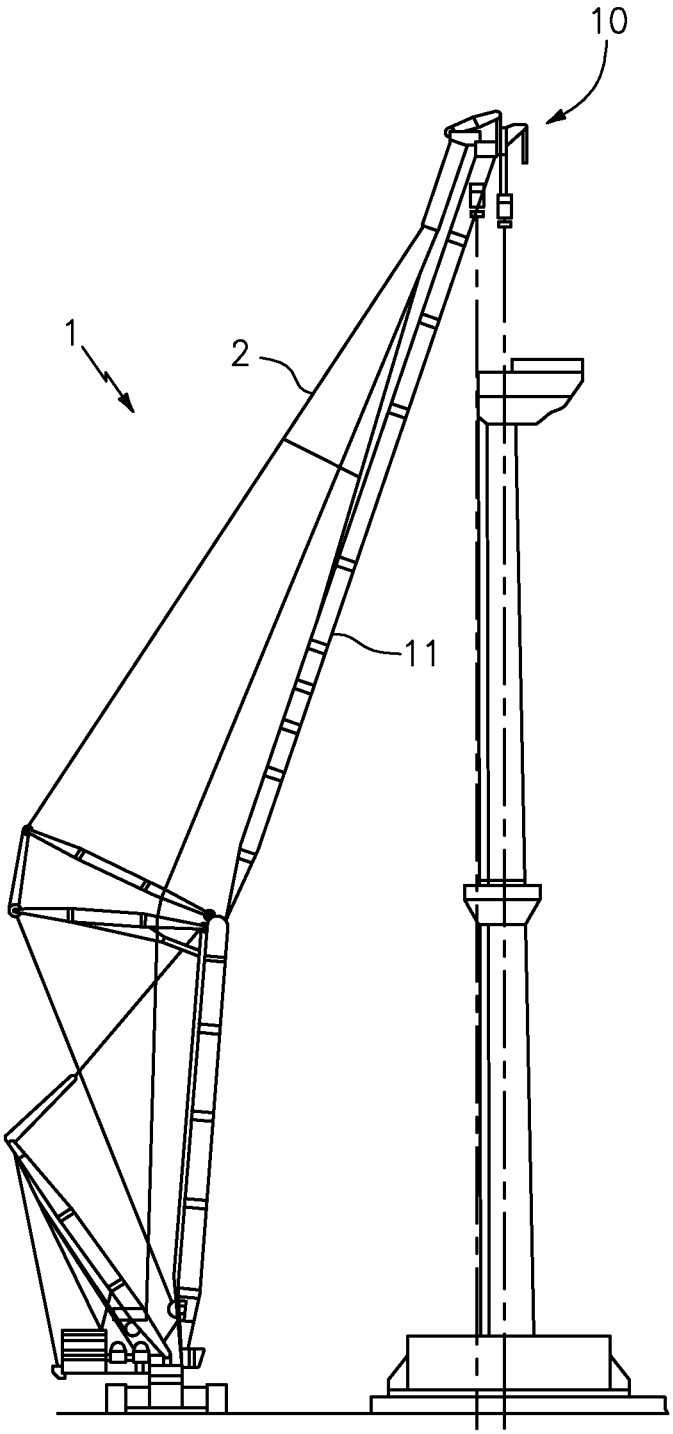
FIG. 1: a side view of a crane having a lattice boom in an aligned position with a bottom hook block in accordance with the invention.

The lattice mast crane 1 shown in FIG. 1 has, in a known manner, a two-part boom 11 which can be luffed about a horizontally lying luffing axis with the aid of a luffing mechanism. The reference numerals used in the following relate exclusively to FIGS. 1 to 3. A rearwardly directed derrick boom is installed behind the main boom 11. The guying of the boom 11 is realized with the aid of the guying rods 2.

At least one hoist rope 12 is guided over one or more pulley blocks of the roller head 10 over the tip of the boom 11 and is reeved several times into the pulley blocks 50 of the bottom hook block 51. To be able to better take up the forces caused by the load and its alignment about a vertical axis, the roller head 10 is configured as widened at the tip of the boom 11. In accordance with the design of the roller head 10, the pulley blocks 50 of the bottom hook block 51 are also accordingly arranged spaced apart from one another so that an almost perpendicular extent of the hoist rope 12 is ensured. A configuration of the crane 1 in accordance with the invention in multirope operation is generally also conceivable. There is a large resistance per se to a rotation of the load and of the bottom hook block 51 with respect to the roller head due to the large spacing of the two outer pulley blocks 50 of the bottom hook block 51.

For the further stabilizing of the position of the bottom hook block 51 and of the load or for the realizing of an actively adjustable positioning of the bottom hook block 51, this is equipped in accordance with the invention with the two control winches 52.

Figure 2B:
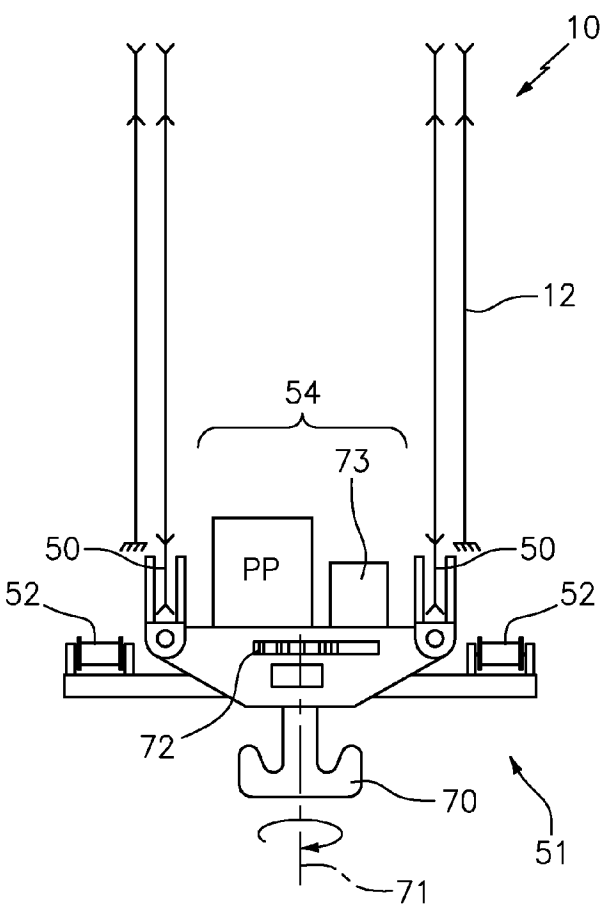
FIG. 2: two detail views of the bottom hook block in accordance with the invention.
Figure 2A:
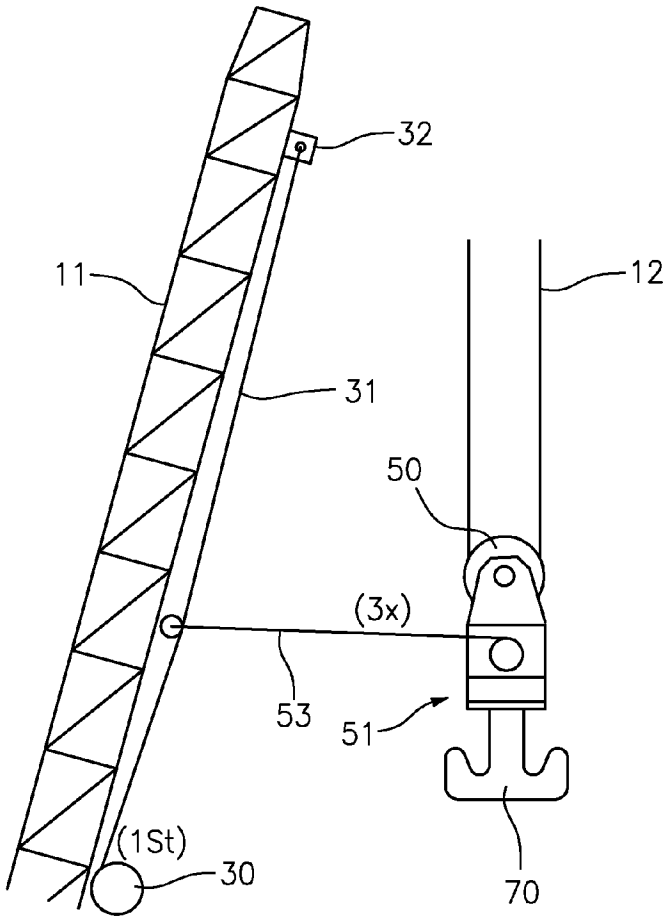

FIGS. 2*a* and 2*b* show detail illustrations of the bottom hook block 51 in accordance with the invention. The bottom hook block 51 is widened in the outwardly disposed side region by directly laterally attached carriers to arrange the two control winches 52 beside the outwardly disposed pulley blocks 50 of the bottom hook block 51. A large torque can be applied by the relative spacing of the winches 52 with respect to one another and the corresponding spaced apart extent of the two control ropes 16, 17 for positioning or aligning the bottom hook block 51 and the load suspended thereon. The laterally attached carriers for the widening at the outer region of the bottom hook block 51 are preferably releasably fastened to the bottom hook block 51 and can selectively be connected thereto or separated therefrom.

The drive 54 of the control winches 52 is attached centrally on the carrier of the bottom hook block 51 so that an autonomous supply of the two winches 52 is ensured. The drive 54, also called a powerpack in the specific embodiment, has a motor, fuel or a fuel tank, a hydraulic tank and a control device for controlling the motor and the hydraulic lines. For the remote control of the wind turbine 100 or of the powerpack 54, a communication unit is provided thereon which communicates the control commands transmitted by the remote control to the respective control devices for controlling the motor and the hydraulic lines.

To ensure an operation of the bottom hook block 51 which is as flexible as possible, the powerpack or the drive 54 can only be attached to the carrier of the bottom hook block 51 as required. If the stabilizing of the bottom hook block 51 in accordance with the invention with the aid of its winches 52 and its outgoing control ropes 53 is not required, the total drive 54 and the corresponding winches 52 can be dismantled from the bottom hook block 61 at their widened sections, whereby the bottom hook block 51 corresponds to a bottom hook block known from the prior art.

To generate a rotary movement of the load hook 70 about is axis of rotation 71, said load hook is rotatably supported at the bottom hook block 51 via a rotating assembly 72. A rotary torque for generating the rotational movement of the load hook 70 about its axis of rotation A is generated via the rotary drive 73. The control of the drive 73 as well as its energy supply likewise takes place via the powerpack of the drive 54. The remote control of the movement of the load hook is consequently equally ensured.

Figure 3B:
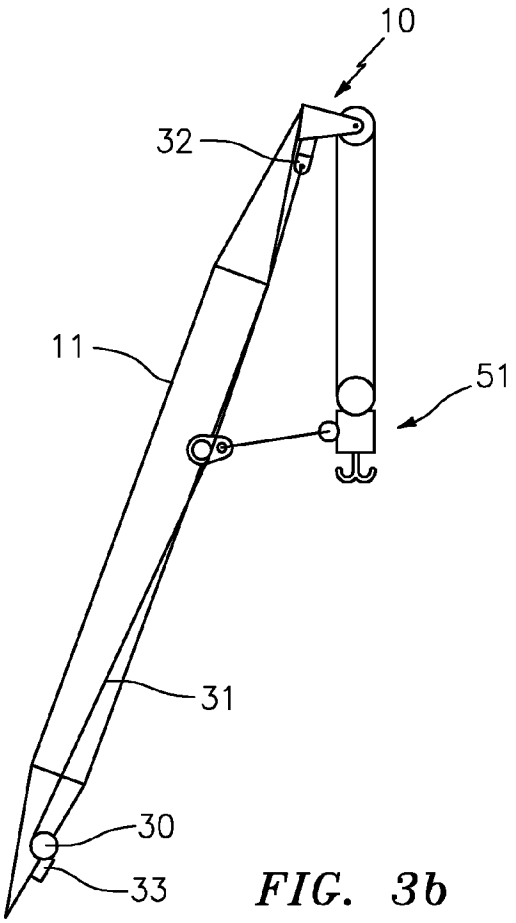
FIG. 3: two further detail representations of the crane in accordance with the invention.

Since the lattice mast crane from the embodiment of FIGS. 1 to 3 does not have any guying realized via ropes, one or more separate guide ropes 31 are required. They extend, as can be seen from FIG. 3*b*, at least over large parts of the boom 11 parallel to the longitudinal axis of the boom 11. At least one winch 30 which spans the guide rope 31 over the boom region up to a fixed point 32 is provided at the boom foot. The fixed point 32 is preferably fixed in the region of the boom head. A supply and control unit 33 is provided to control and supply the winch 30. Alternatively, the fixed point 32 can also be defined at the boom foot and the respective winch or winches 30 for spanning the guide rope 31 are accordingly attached in the boom head region.

Figure 3A:
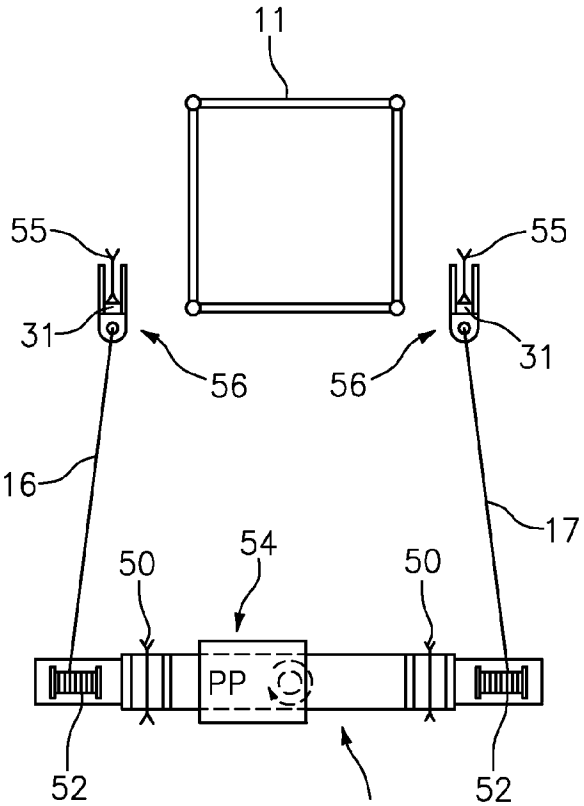

In accordance with FIG. 3*a*, the control ropes 53 running out from the winches 52 have a block 56 at their free ends which is equipped with a roller 55. The control ropes 53 are accordingly fastened via the block 56 to a single guide rope or to a plurality of separate guide ropes 31 at the boom 11 so that a longitudinally displaceable support along the longitudinal axis of the boom 11 is made possible by means of the roller 55 of the control ropes 53. It is hereby ensured that an optimum angle of the control ropes 53 with respect to the boom 11 is also always present to align the bottom hook block 51 to the load with a changeable height of the bottom hook block 51.

In an alternative embodiment of the lattice mast crane 1 in accordance with the invention, the individual guide ropes 31 are replaced by corresponding guide rails. In this respect, the control ropes 53 are attached to the guide rail at the boom via a corresponding slide connection, whereby a longitudinally displaceable arrangement of the control ropes 53 at the boom 11 is likewise ensured.

The control ropes 53 can also be configured with multiple strands. The rope cross-section can hereby be reduced.

The lattice mast crane 1 in accordance with the invention has, on the one hand, a larger resistance to a rotation of the load as a result of the wind speeds which occur due to the widened design of the roller head 10 at the tip of the boom 11 as well as to the correspondingly enlarged spacing between the pulley blocks 50 on the bottom hook block 51. On the other hand, a more stable and more influenceable alignment or positioning of the bottom hook block 51 or of the suspended load is achieved by the arrangement in accordance with the invention of one or more winches 52 with corresponding control ropes 53 at the bottom hook block 51.

Figure 4:
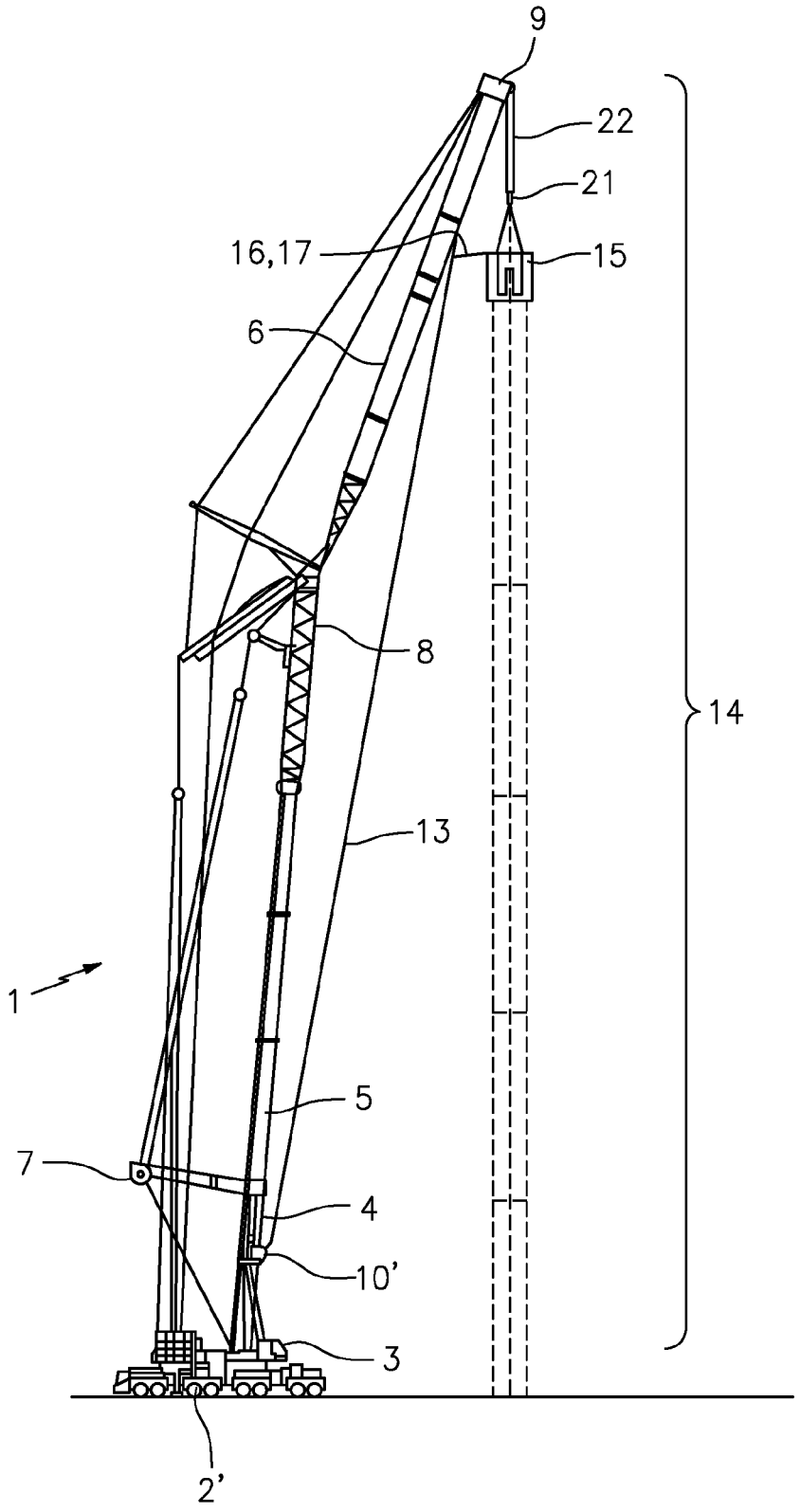
FIG. 4 a side view of a mobile crane in accordance with the second aspect of the invention with a telescopic boom in an aligned position.
Figure 5:
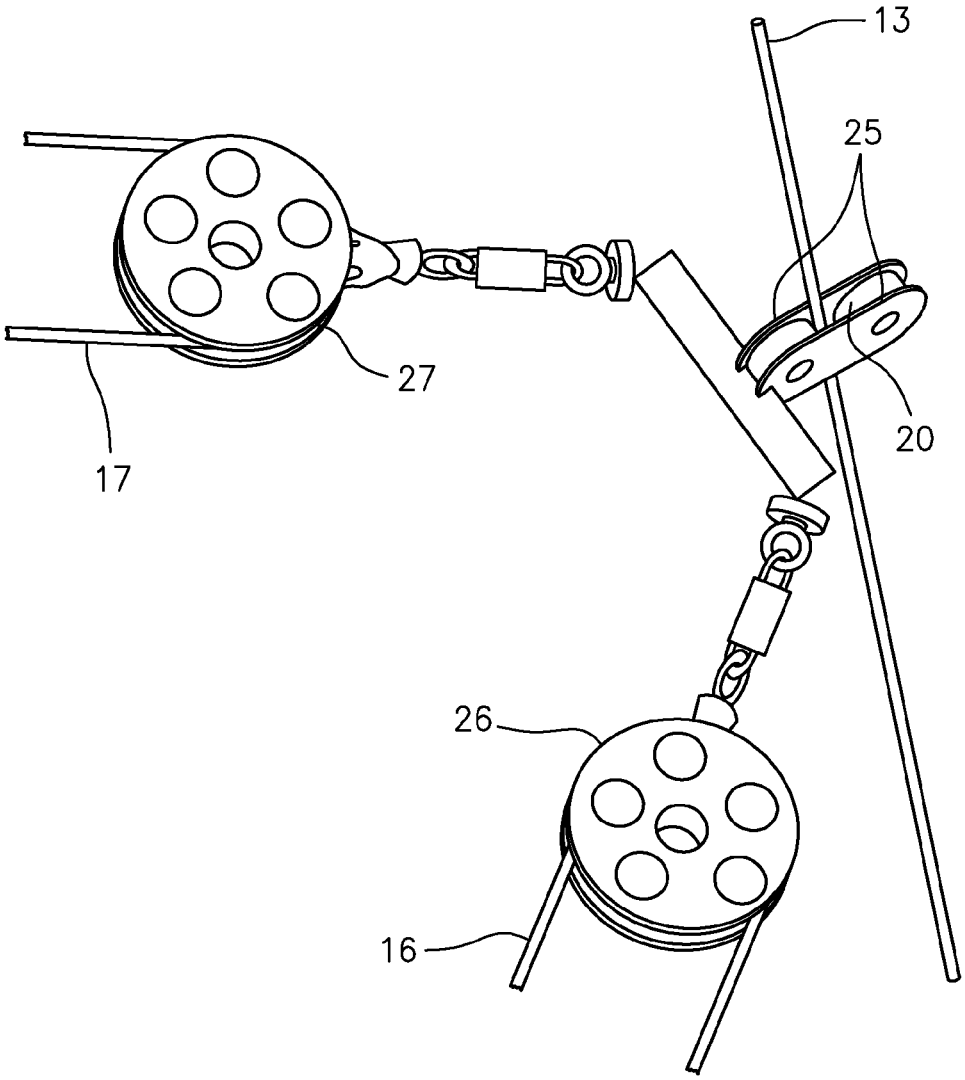
FIG. 5: a detail view of the connection point between the guide rope and the control ropes.

The mobile crane 1 shown in FIG. 4 has, in a manner known per se, an undercarriage 2' which is configured as a truck and on which a superstructure 3 is rotatably supported about an upright axis. The reference numerals used in the following relate exclusively to FIGS. 4 and 5. The superstructure 3 carries a boom system 14 which is luffable about a horizontal axis and which has a joint section 4 pivotally connected to the superstructure 3 as well as a plurality of telescopic sections 8 which can be telescoped out of said joint section. A luffable lattice tip 6 which can be connected via lattice pieces is arranged at the innermost telescopic section of the main boom 5. The main boom 5 is guyed by means of a guying 7 which is formed as a spatial Y guying known per se.

A hoist rope 22 is guided over the luffing tip 8 via a pulley block 9 and carries a load hook 21. A frame 15 is suspended at the load hook 21 and serves for receiving a rotor blade, not shown in any more detail here, of a wind turbine.

To stabilize the frame 15, in particular during the installation of the rotor blade at the wind rotor hub, only one single winch 10 is now provided which is located almost on the line of symmetry of the boom system 14. The latter is directly attached to the pivotal connection piece of the main boom 5 and is coupled to the central crane system by the provided energy supply and the control link. The control of the winch 10 takes place, for example, starting from the crane control, via the bus system.

Starting from the winch 10, the guide rope 13 extends to the outer region of the boom system 14. The outer end of the rope 13 can, depending on the use, be flexibly fastened to any desired point of the boom system 14. In the embodiment of FIG. 4 shown, the guide rope 13 is arranged at the luffing tip 6 close to the region of the pulley block 9.

Depending on the crane movement which takes place, for example a luffing of the luffing tip 6 or a telescoping out of the main boom 5 of the boom system 14, the winch 10 is controlled synchronously by the control. A maximum coiling up force is furthermore defined for the winch 10. If the permitted winding up force of the winch is exceeded, the winch automatically lets out rope.

Starting from the frame 15, the two control ropes 16, 17 run in the direction of the guide rope 13. The connection link 20 which can be seen from the detailed illustration in FIG. 5 serves to connect the control ropes 16, 17 to the guide rope 13. The connection link 20 has a double roller 25 which is guided along the guide rope 13. The two pulley blocks 26, 27 are movably fastened to the connection link symmetrically to the double roller 25. The control ropes 16, 17 are redirected by the pulley block 26, 27 and are guided back to the frame 15.

On the frame itself, the control ropes 16, 17 are redirected by further pulley blocks and are controlled by a corresponding winch drive. The control ropes 16, 17 can be correspondingly controlled via the winch drive on the frame 15 to stabilize and/or readjust the horizontal position of the frame 15 at the hoisting height. The use of the individual pulley blocks provides a force reduction in the rope and in the rope drive of the frame 15.

It must again be explicitly mentioned at this point that the invention is not restricted to the taking up of a rotor blade. Any desired load fitting into the receiver of the frame 15 can be taken up via the frame 15.

The influence by the control ropes 16, 17 on the boom system 14 is substantially reduced by the use of a single guide rope in comparison with known solutions from the prior art. The symmetrical arrangement of the winch 10 as well as the course of the guide rope 13 along the plane of symmetry of the boom system 14 bring about the decisive advantage that the side load on the boom system 14 is very largely prevented. The previous known embodiments which focus on a plurality of guide ropes or on the use of the present guying have the disadvantage that the guide ropes extend outside the plane of symmetry laterally beside the boom system 14. This results in a substantial side load of the boom system 14 on an unequal application of force by the control ropes on the corresponding guide ropes.

Figure 6:
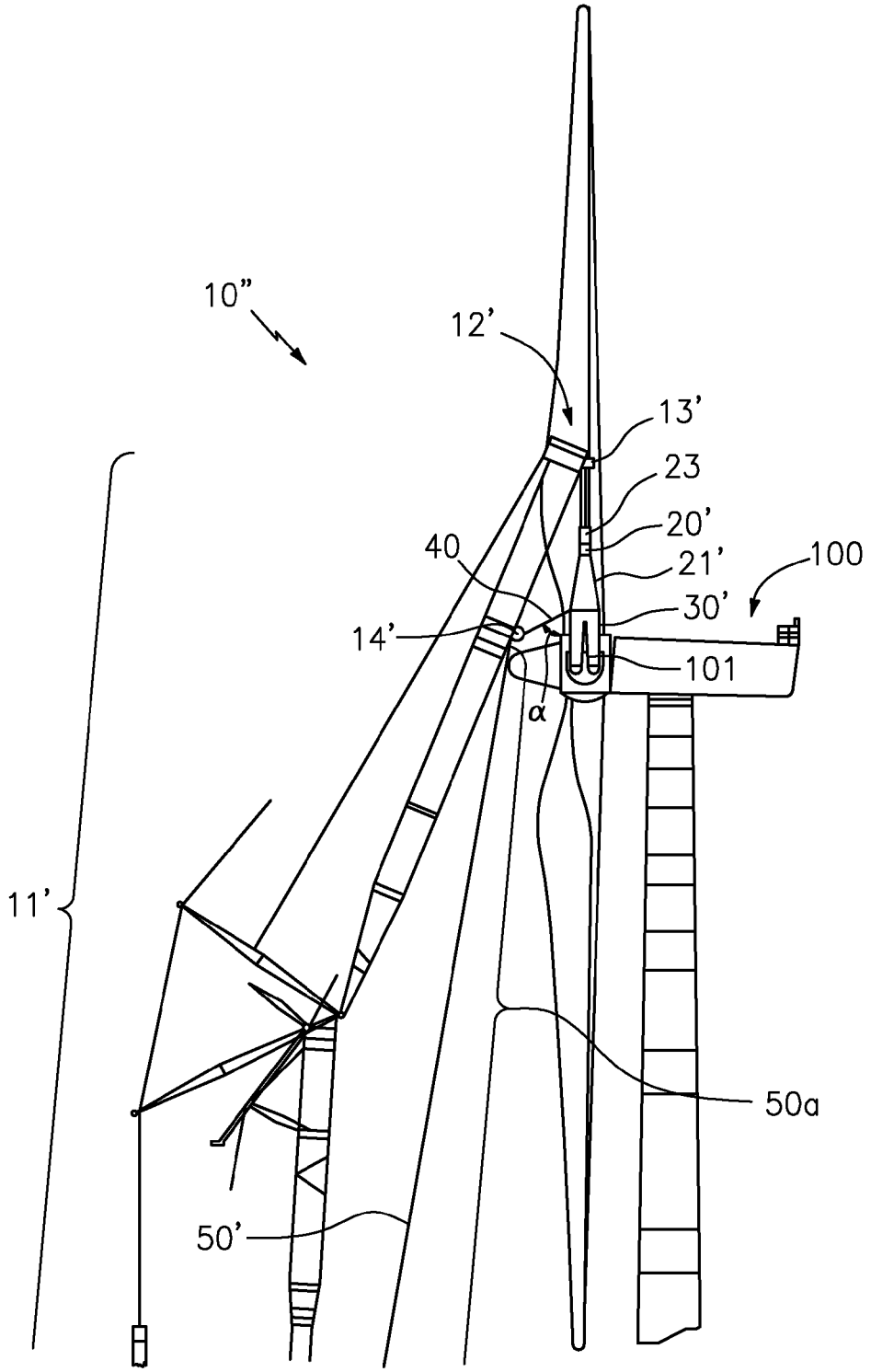
FIG. 6: a side view of the crane in accordance with the third aspect of the invention with a taken up rotor blade of a wind turbine.

FIG. 6 shows a crane structure 10" for the installation of wind turbines 100. The reference numerals used in the following relate exclusively to FIGS. 6 to 9. The specific embodiment of the crane structure 10, in particular of the boom system 11', is not significant for the invention. The idea in accordance with the invention can generally be used with any type of boom systems 11' such as with a lattice mast crane as well as a telescopic crane.

A yoke 30' is suspended via the suspension means 21' at the load hook 20'. The yoke 30" includes a frame which takes up a rotor blade 101 of the wind turbine 100 to be taken up in a gentle and damage-free manner. The yoke 30' furthermore includes a series of independently working assemblies, such as winches, drives, operating means, which serve inter alia for actuating the outgoing control ropes 40.

The control ropes 40 are directly controlled to the boom system 11' for the adjustment and stabilization of the yoke 30'. In contrast to the prior art, no additional guide rope is spanned at the boom system 11' as a guide possibility of the control ropes 40. To simplify the crane design and as part of the cost minimization, instead the hoist rope 50' of the crane 10" is used.

The hoist rope 50' extends from the roller head 12' to the hook block 23 in order to be guided back to the boom system 11 after a load-dependent reeving at the hook block 23. In detail, the rope course of the hoist rope 50" running back from the hook block 23 is determined by the pulley block 13' arranged at the roller head 12' and by the pulley block 14' mounted on the boom system 11' at the height of the rotor hub. At the end side, the hoist rope is attached to the lower attachment point, not shown, which is located at the pivotal connection piece, at the luffing ram or at the revolving deck of the crane in dependence on the set hoisting conditions or on the crane design. In the drawing shown, the partial region 50*a* of the hoist rope 50', which extends from the pulley block 14' to the lower pivotal connection point almost parallel to the boom axis, is used as a guide rope region 50*a*.

Figure 7:
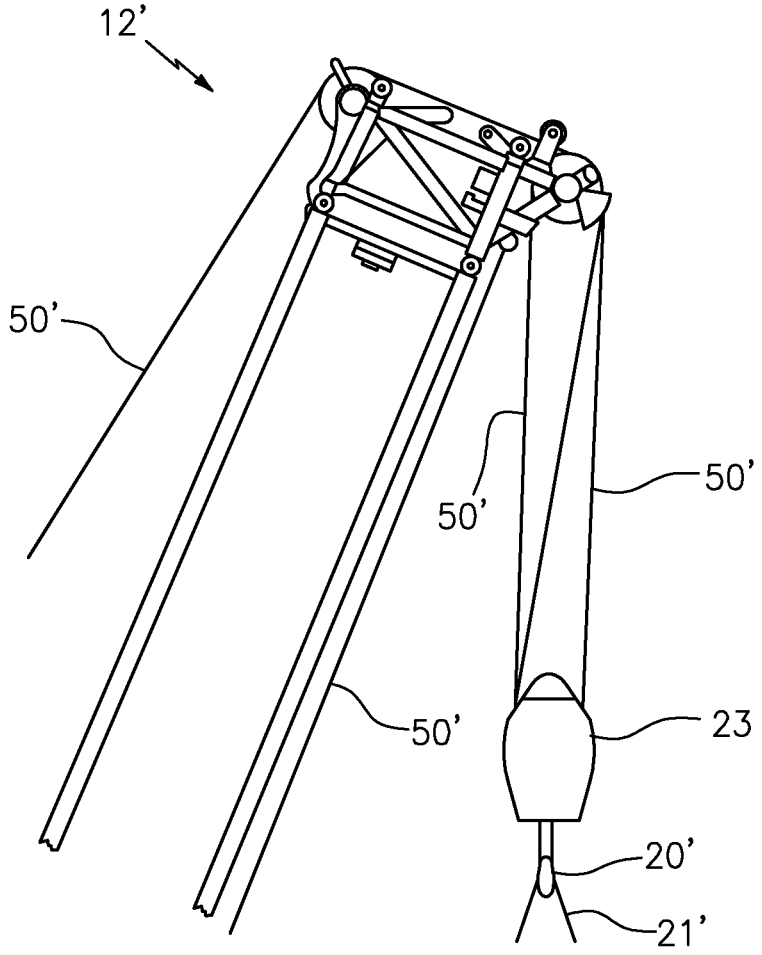
FIG. 7: a detail representation of the roller head in accordance with FIG. 6.

An enlarged illustration of the roller head 12' can be seen from FIG. 7. This again provides an exact overview of the specific rope extent of the hoist rope 50' at the roller head 12'.

If the yoke 30' together with the rotor blade 101 is suspended at the hook block 23, a sufficient tension of the hoist rope 50' then results in the guide rope region 50*a*. The installation of the rotor blade 101 at the wind turbine 100 already results in a substantial reduction of the hoisting load. This immediately has effects on the pulling force in the hoist rope 50' and consequently on the tension in the guide rope region 50*a*. At the same time, however, a large part of the wind attack surface is eliminated so that the hoist rope tension is sufficient to avoid a dangerous rotating with the load-relieved yoke 30'.

The number of reevings of the hoist rope 50' at the hook block 23 is selected in dependence on the yoke 30' used. There is the possibility of using yokes with different physical dimensions which are especially configured for different rotor blades having different geometrical dimensions and weights. The total weight of the yoke 30, the hook block 23 and the taken-up rotor blade 101 must be looked at for the reeving. The number of reevings reduces the pulling force at the hoist rope. This is necessary in order not allow the pulling force in the rope to become higher than permitted. This effect is actually unwanted in the region 50*a*, even though it is unalterable.

The pulley block 14' is attached just below the target height (hub height) at the boom system 11' to be reached by the upper yoke edge. Even before the yoke 30 reaches the target height, the control ropes 40 running along on the guide rope region 50*a* of the hoist rope 50' by means of connection link 60 abut the pulley block 14' especially configured therefor. The direct abutment of the connection link 60 at the pulley block 14' is assisted by a moving of the connection link 60 into a corresponding apparatus 200 at the pulley block 14'.

The reasons for this abutment are that, at the ultimately reached hoisting height (height for the installation of the rotor blade 101 at the wind turbine 100), the connection link 60 is laterally fixed by the pulley block 14' or by the apparatus 200 so that the yoke 30' can be controlled and positioned very precisely via the control ropes 40 in this case.

Since the hub height of the wind turbine 100 and thus the moved out state of the boom system 11' is known, the pulley block 14' can be bolted to the boom system at the corresponding height on the basis of this knowledge to achieve a fixing of the connection link 60. To be very free in the positioning of the pulley block 14', the counter-connection elements at the boom are realized by a clamping,bolt connections or other fixing mechanisms.

Since a certain horizontal diagonal pull $\alpha$ of the control ropes 40 can be tolerated (the yoke 30' has to be configured for this), a matching bolting point for the pulley block 14' will be found for each hub height of the wind turbine 100. The diagonal pull $\alpha$ is desired since the connection link 60 can hereby be held in engagement better.

Figure 8:
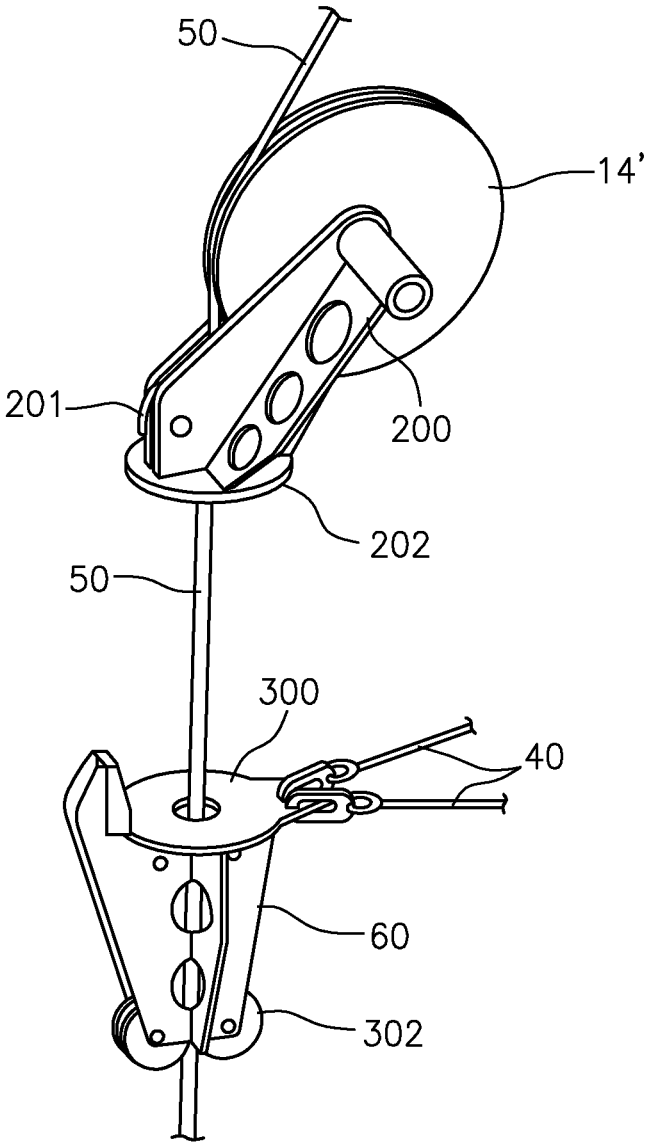
FIG. 8: a schematic diagram of the pulley block in accordance with the fourth aspect of the invention with an apparatus for catching the connection link in a perspective view.
Figure 9:
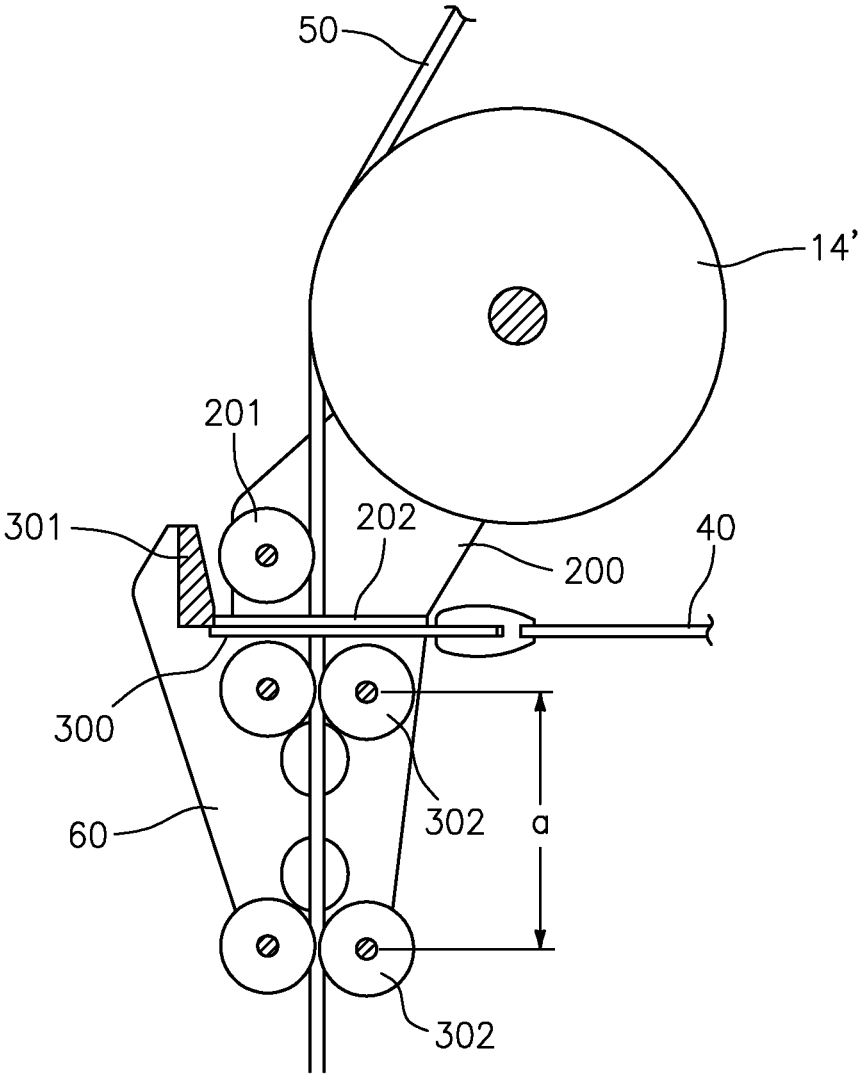
FIG. 9: a sectional representation of the apparatus of FIG. 8 with a caught connection link.

An embodiment of the pulley block 14' and of the connection link 60 can be seen from the schematic diagram of FIG. 8 as well as from the corresponding sectional representation in FIG. 9. The pulley block 14' is stiffly positioned with its axis of rotation at the boom system 11'. The plate 200 is suspended at the pulley block 14' and is pivotally supported about the axis of the pulley block. The plate 200 furthermore carries a holding roller 201 which positions the plate 200 softly and damped by the hoist rope 50'. If, for example, the plate should be pivotally connected to the right, the coil angle of the hoist rope 50' about the pulley block 14' then increases in this respect. The pulling force acts as a restoring force in the hoist rope 50.

The plate 200 has an metal abutment sheet 202 at its lower side, said metal abutment sheet not fully surrounding the hoist rope 50. The center of the circular metal abutment plate 202 lies on the longitudinal axis of the hoist rope 50.

The connection link 60 likewise has a plate, the metal abutment sheet 300, whose shape corresponds to the metal abutment sheet 202 of the pulley block 14. The catching and holding procedure is as described in the following.

The connection link 60 is taken along by the yoke 30' pulling upwardly via the control ropes 40. When the two metal abutment sheets 202, 300 approach one another, they are aligned to one another via the slide block 301 of the connection link 60 until both metal abutment sheets 202, 300 lie on one another, as explicitly shown in FIG. 9. The system is now connected in shape-matched form via the slide block 301 so that forces from the control ropes 40 can be transmitted from the slide block 301 onto the metal abutment sheet 202 of the pulley block 14.

The connection link 60 is furthermore still rotatable about the rope axis and can be aligned in accordance with the control rope forces. In this case, the slide block 301 slides on the outer side of the metal abutment sheet 202 with the hoist rope 50 as the center.

The connection link 60 held at abutment can only move minimally perpendicular to the hoist rope 50 due to the large spacing a of the link rollers 302 and thus guarantees a fixed point at which the control ropes 40 of the yoke 30' can engage. A precise and fast installation of the rotor blade 101 is made possible.

The crane 10 in accordance with the invention also still has to be able to raise heavy loads without any larger reequipping. A particularly heavy load on the installation of wind turbines 100 is, for example, represented by the machine house. The reeving of the hoist rope 50 at the hook block 23 is selected accordingly; however, in this extreme load case, the introduction of the additional force in the guide rope region 50*a* of the hoist rope 50 into the boom system 11 should be avoided at all costs. The hoist rope 50 is fastened to the boom system 11 at the end side by rope clamping for this reason. Depending on the load type, the guide rope region 50*a* can be enlarged, reduced or saved due to the fastening possibility variable at the end side.

For example, the machine house of the wind turbine 100 is first brought into the installation position. For this purpose, the end of the hoist rope 50 is held at the upper end of the boom system 11 via the rope clamp. A guide rope region 50*a* is not necessary due to the small wind attacking surface.

Subsequently to this, the yoke 30 is fastened to the hook block. In this respect, the rope clamp, to whose end the installation rope of the reeving winch of the crane 10 is fastened, is pulled over the reeving winch to the boom foot and is suspended.

The invention claimed is:

1. A crane having an elongated bottom hook block (51), a load hook (70) centrally coupled to an underside of the elongated bottom hook block (23, 51), carriers directly laterally attached to the bottom hook block (51) to widen the bottom hook block (51) in outwardly-disposed side regions, two control winches (52) mounted upon the carriers to increase the resulting spacing of the winches (52), and each winch (52) having an outgoing control rope (53) connected or connectable to a boom of the crane for securing and aligning load position or bottom hook block (51) position.

2. The crane in accordance with claim 1, wherein a drive (54) is arranged for supplying the control winches (52).

3. The crane in accordance with claim 2, wherein the drive is a hydraulic drive.

4. The crane in accordance with claim 1, wherein at least one of the control ropes is displaceably connected or connectable to the crane boom almost parallel to a longitudinal boom axis.

5. The crane in accordance with claim 1, wherein at least one guide rope for guiding the control ropes is spanned almost parallel to a longitudinal axis of the boom.

6. The crane in accordance with claim 5, wherein the guide rope is fastened at a fixed point to the boom and spanned by at least one additional control winch.

7. The crane in accordance with claim 6, wherein the guide rope is fixed to a head of the boom.

8. The crane in accordance with claim 5, wherein said single guide rope is spanned without any guying function from a foot of the boom almost parallel to the longitudinal boom axis and is fastened at an end point thereof to the boom.

9. The crane in accordance with claim 8, comprising two separate pulley blocks (26, 27) about which the control ropes (16, 17) are respectively wound, and a connection link (20) having a double roller (25) movably contacting the guide rope (13) and with the separate pulley blocks (26, 27) each movably fastened to the connection link (20).

10. The crane in accordance with claim 1, wherein the control ropes are guided along a guide rope region of a crane hoist rope.

11. The crane in accordance with claim 1, wherein at least one control rope has a block with a roller at its free end.

12. The crane in accordance with claim 1, wherein the control winches are releasably connected to the bottom hook block.

13. The crane in accordance with 1, comprising a pair of pulley blocks (50) inwardly mounted on said hook block (51) from said control winches (52), and a plurality of hoist ropes (12) each being wound around a respective pulley block (50).

14. The crane in accordance with claim 1, having a pair of rollers (55), with each said control rope (53) wound around a respective roller (55) at an end opposite said respective control winch (52), a plurality of guide ropes (31) for guying the boom (11), and a plurality of guide blocks (56), with each guide block (56) mounting a respective roller (55) on a respective guide rope (31) such that the rollers (55) are longitudinally displaceable along an axis of the boom (11).

15. The crane in accordance with claim 1, comprising a pulley block (14') mounted on the boom (11) and about which a hoist rope (50) is wound, and the hoist rope (50) having at least one reeving (50*a*) extending from the pulley block (14') to a lower pivotal connection point and constituting guide rope region (50*a*), such that presence of an additional guide rope is omitted.

16. The crane in accordance with claim 1, additionally comprising a rotating assembly (72) rotationally supporting the load hook (70) at the underside of the bottom hook block (51), and a drive (54) for the control winches (52) mounted on top of the bottom hook block (51) and including a rotary drive (73) for the load hook (70).

17. The crane in accordance with claim 1, wherein the spacing between the control winches (52) is maximized to generate maximum torque for positioning or aligning the bottom hook block (51) with minimal force of the control ropes (53).

18. The crane in accordance with claim 1, wherein the control winches (52) are each disposed on opposite, outermost edges of the carriers.

19. A crane having a bottom hook block (51), and load suspension means (21) coupled to the bottom hook block (23, 51), wherein the bottom hook block (51) has at least one winch (52) having an outgoing control rope (16, 17) connected or connectable to a boom of the crane for securing and aligning load position or bottom hook block position, additionally comprising a pulley block (14') mounted on the boom (11) and about which a hoist rope (50) is wound, the hoist rope (50) having at least one reeving (50*a*) extending from the pulley block (14') to a lower pivotal connection point and constituting guide rope region (50*a*), such that presence of an additional guide rope is omitted, a plate (200) suspended from the pulley block (14') and pivotally supported about an axis of the pulley block (14'), a holding roller (201) carried by the plate (200) for positioning the plate (200) against the hoist rope (50), and a circular metal abutment sheet (202) at a lower side of the plate (200) and not fully surrounding the hoist rope (50), with a center of the circular metal abut sheet (202) lying on a longitudinal axis of the hoist rope (50), a link (60) connected to the control rope (40) and comprising a metal abutment sheet (300) corresponding in shape to the metal abutment sheet (202) of the plate (200) suspended from the pulley block (14'), and a slide block (301) laterally arranged against the metal abutment sheet (300), such that when the two metal abutment sheets (202, 300) approach one another, the slide block (301) aligns these two sheets (202, 300) to lie on one another and couple the connection link (60) and pulley block (14') in shape-matched form and transmit force from the control rope (40) onto the metal abutment sheet (202) of the pulley block (14').

20. The crane in accordance with claim 19, wherein the connection link (60) comprises a pair of link rollers (302) separated a distance (a) from one another in a direction along a longitudinal axis of the hoist rope (50), and each said roller pair (302) positioned to contact the hoist rope (50) extending therebetween.

21. The crane according to claim 20, having a pair of control ropes (40) clipped onto the sheet (300) of the connection fink (60).

22. A crane having an elongated bottom hook block (51), a load hook (70) centrally coupled to an underside of the elongated bottom hook block (23, 51), two pulley blocks (50) directly mounted on top of the bottom hook block (51) and around which hoisting ropes (12) of the crane are respectively wound, carriers directly laterally attached to the bottom hook block (51) to widen the bottom hook block in outwardly-disposed side regions from the pulley blocks (50), two control winches (52) mounted upon the carriers to be laterally outwardly disposed from the respective pulley blocks (50), with each winch (52) having an outgoing control rope (53) connected or connectable to a boom of the crane for securing and aligning load position or bottom hook block (51) position, a rotating assembly (72) rotatably supporting the load hook (70) at the underside of the bottom hook block (51), a rotary drive (73) attached on top of the bottom hook block (51) for generating a rotational movement of the load hook (70), and a drive (54) for the control winches (52) centrally mounted on top of the bottom hook block (51).

23. The crane in accordance with 22, wherein the drive is releasably connected to the bottom hook block.

* * * * *